US005670302A

United States Patent [19]

Lau et al.

[11] Patent Number: 5,670,302

[45] Date of Patent: Sep. 23, 1997

[54] PHOTOGRAPHIC ELEMENTS CONTAINING NEW MAGENTA DYE-FORMING COUPLERS

[75] Inventors: Philip T. S. Lau; Louis Joseph Rossi; Stanley Wray Cowan, all of Rochester, N.Y.

[73] Assignee: Eastman Kodak Company, Rochester, N.Y.

[21] Appl. No.: 665,026

[22] Filed: Jun. 16, 1996

[51] Int. Cl.[6] ..... G03C 7/34

[52] U.S. Cl. ..... 430/386; 430/387; 430/552; 430/553

[58] Field of Search ..... 430/552, 553, 430/386, 387

[56] References Cited

U.S. PATENT DOCUMENTS

| | | | |
|---|---|---|---|
| 2,313,138 | 3/1943 | Frohlich et al. | 95/6 |
| 4,208,210 | 6/1980 | Sakai et al. | 430/140 |
| 4,439,513 | 3/1984 | Sato et al. | 430/203 |
| 4,524,132 | 6/1985 | Aoki et al. | 430/553 |
| 4,565,777 | 1/1986 | Ogawa et al. | 430/553 |
| 5,283,163 | 2/1994 | Lestina et al. | 430/505 |
| 5,380,638 | 1/1995 | Takizawa et al. | 430/552 |
| 5,427,020 | 6/1995 | Deguchi et al. | 96/56.2 |
| 5,476,757 | 12/1995 | Lau et al. | 430/384 |

FOREIGN PATENT DOCUMENTS

| | | | |
|---|---|---|---|
| 3248387 | 7/1983 | Germany . | |
| 7325934 | 2/1973 | Japan | 430/552 |
| 61/156126 | 7/1986 | Japan . | |
| 259253 | 11/1986 | Japan . | |
| 2118637 | 5/1990 | Japan | 430/553 |
| 04/321034 | 11/1992 | Japan . | |
| 843497 | 8/1960 | United Kingdom | 430/553 |
| 1439106 | 6/1976 | United Kingdom | 430/553 |

*Primary Examiner*—Lee C. Wright
*Attorney, Agent, or Firm*—Arthur E. Kluegel

[57] ABSTRACT

A photographic element comprises a light sensitive silver halide emulsion layer having associated therewith a magenta coupler represented by formula (I):

(I)

wherein:

$R_1$ represents a hydrogen atom or an alkyl group;

$R_2$ represents an alkyl group;

Ar represents a phenyl or naphthyl group;

X represents a substituent and "n" represents an integer of from 1 to 5; and

Z represents a hydrogen atom or a group which can be split off by the reaction of the coupler with an oxidized color developing agent.

The described naphtholic coupler provides a magenta dye image rather than the cyan dye image common to naphtholic couplers.

18 Claims, No Drawings

PHOTOGRAPHIC ELEMENTS CONTAINING NEW MAGENTA DYE-FORMING COUPLERS

FIELD OF THE INVENTION

This invention relates to a photographic silver halide element containing magenta dye-forming couplers derived from 2-acylamino-1-naphthols.

BACKGROUND OF THE INVENTION

Color images are commonly obtained in the silver halide photographic art by reaction between the development product of a silver halide developing agent (e.g., oxidized aromatic primary amine developing agent) and a color-forming compound commonly known as a coupler. The reaction between the coupler and oxidized developing agent results in coupling of the oxidized developing agent to the coupler at a reactive site on the coupler, known as the coupling site, and yields a dye. The subtractive process of color formation is ordinarily employed in color photographic elements, and the dyes produced by coupling are usually cyan, magenta, or yellow dyes which are formed in or adjacent to silver halide emulsion layers sensitive to red, gren, or blue radiation, respectively.

Couplers well known for forming magenta image dyes are the heterocyclic pyrazolone and pyrazolotriazole couplers as described, for example, in U.S. Pat. Nos. 2,600,788, 3,725,065, 3,725,067, 3,788,309, 3,810,761, 4,443,536, 4,540,654, and 4,621,046. However, such known couplers often have drawbacks. One such drawback of these heterocyclic magenta dye-forming couplers is that they are expensive and difficult to synthesize, requiring difficult multistep synthetic methods such as described in U.K. Patents 1,247,493 and 1,252,418.

Another drawback is that the magenta image dyes formed from such couplers often have much poorer light stabiity than image dyes generated from the yellow and cyan couplers, so that the dyes fade too fast when exposed to daylight. Photographic elements containing such imaging dyes can exhibit an unacceptable decrease in absorption of green light relative to blue and red light, resulting in color images that appear too green.

A further drawback of the pyrazolone and pyrazolotriazole couplers is the lack of useful coupling-off groups other than thiol for the pyrazolones and chloro for the pyrazolotriazoles. For instance, aryloxy coupling-off groups are very important in the photographic art for the imagewise release of photographically useful groups such as development accelerators, development inhibitors, bleach accelerators, and the like, but there are no good synthetic methods for attaching aryloxy coupling-off groups to the pyrazolone and pyrazolotriazole couplers. In addition, the prior art couplers present stability problems when the desired aryloxy groups are appended to the couplers.

Naphthols are well-known cyan dye-forming couplers whose image dyes have their maximum absorptions in the range of 650 to 700 nm or even greater than 700 nm, as described, for example, in U.S. Pat. Nos. 2,313,138, 4,208,210, 5,283,163, 5,380,638, 5,476,757, and 5,427,020; Japanese patent applications JP04/321034 and JP61/156126; and German Patent Nos. DE3,248,387 and DE2,504,844.

A problem to be solved is to provide a new class of magenta dye-forming couplers that provide useful photographic properties and that can be prepared by simpler methods of synthesis than those required for the preparation of pyrazolone or pyrazolotriazole couplers.

SUMMARY OF THE INVENTION

The invention provides a photographic element which comprises a light sensitive silver halide emulsion layer having associated therewith a magenta coupler represented by formula (I):

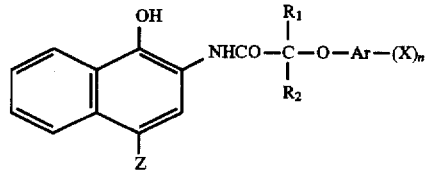

(I)

wherein $R_1$ represents a hydrogen atom or an alkyl group;

$R_2$ represents an alkyl group;

Ar represents a phenyl or naphthyl group;

X represents a substituent and "n" represents an integer of from 1 to 5; and

Z represents a hydrogen atom or a group which can be split off by the reaction of the coupler with an oxidized color developing agent.

The described naphtholic coupler provides a magenta dye image rather than the cyan dye image common to naphtholic couplers.

The invention also contemplates the couper compound itself, the dye formed from the coupler, a silver halide emulsion layer containing or associated with the coupler, and an imaging process employing the element of the invention.

The invention provides a new class of magenta dye-forming couplers that provide useful photographic properties and that can be prepared by simpler methods of synthesis than those required for the preparation of pyrazolone or pyrazolotriazole couplers.

DETAILED DESCRIPTION OF THE INVENTION

The invention as outlined in the Summary of the Invention may be more particularly described as follows.

In Formula (I), the alkyl group which may satisfy the description of either $R_1$ or $R_2$ may be a linear, branched or cyclic, saturated or unsaturated, substituted or unsubstituted alkyl group. Suitably, the alkyl group comprises 1 to 25 carbon atoms (e.g., methyl, isopropyl, cyclopropyl, oleyl, dodecyl, or trifluoromethyl). Typically, when $R_1$ represents a hydrogen atom, $R_2$ represents a linear or branched alkyl group of 1 to 18 carbon atoms (e.g., methyl, isopropyl, decyl or octadecyl); and when $R_1$ represents an alkyl group, each or $R_1$ and $R_2$ represents an alkyl group, that together contain a total of 2 to 18 carbon atoms.

Ar represents a phenyl or naphthyl group, and if Ar is a naphthyl group, it may be attached to the oxygen at any position.

X represents any of the substituent groups as defined hereafter, including, for example, a halogen atom such as F, Cl or Br; a cyano group; a hydroxy group, an alkoxy group such as methoxy, t-butoxy or tetradecyloxy; a substituted or unsubstituted aryloxy group such as phenoxy, 4-t-butylphenoxy or 4-dodecylphenoxy; an alkyl or aryl acyloxy group such as acetoxy or dodecanoyloxy; an alkyl or aryl acylamino group such as acetamido, benzamido, or hexadecanamido; an alkyl or aryl sulfonyloxy group such as methylsulfonyloxy, dodecylsulfonyloxy, or 4-methylphenylsulfonyloxy; an alkyl or aryl sulfamoylamino group such as N-butylsulfamoylamino, or N-4-t-butylphenylsulfamoylamino; an alkyl or aryl sulfonamido group such as methanesulfonamido, 4-chlorophenylsulfonamido or hexadecanesulfonamido; a ureido group such as methylureido or phenylureido; an alkoxycarbonylamino or aryloxycarbonylamino group such as methoxycarbonylamino or phenoxycarbonylamino; a carbamoyl group such as N-butylcarbamoyl or N-methyl-N-dodecylcarbamoyl; a carboxy group; an alkyloxy or aryloxy carbonyl group such as hexadecyloxycarbonyl; an alkylamino or arylamino carbonyl group such as a tetradecylaminocarbonyl group; an alkyl or aryl sulfamoyl group such as a butylsulfamoyl group; a perfluoroalkyl group such as trifluoromethyl or heptafluoropropyl.

"n" represents an integer of 1 to 5, and if n is more than 1 then the substituents X may be the same or different.

Typically, the group Ar and its attached groups X together comprise a substituted aryl group of 6 to 30 carbon atoms, such as a 2,4-di-t-amylphenyl group, a 3-pentadecylphenyl group, a 4-hexadecyloxycarbonylphenyl group, a 4-hexadecylsulfonamidophenyl group, a pentafluorophenyl group, a 4-cyanophenyl group, a 2-tetradecyloxyphenyl group, or a 4-octadecylsulfonylphenyl group.

Z represents a hydrogen atom or a group which can be split off by the reaction of the coupler with an oxidized color developing agent, known in the art as a "coupling-off group." Such groups can determine the chemical equivalency of a coupler, i.e., whether it is a 2-equivalent or 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

The presence of hydrogen at the coupling site (the site on the coupler molecule at which Z is attached) provides a 4-equivalent coupler, and the presence of a coupling-off group other than hydrogen usually provides a 2-equivalent coupler. Representative classes of such coupling-off groups include, for example, chloro, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio, and arylazo. These coupling-off groups are described in the art, for example, in U.S. Pat. Nos. 2,455,169, 3,227,551, 3,432,521, 3,467,563, 3,617,291, 3,880,661, 4,052,212, and 4,134,766; and in U. K. Patents and published applications 1,466,728, 1,531,927, 1,533,039, 2,066,755A, and 2,017,704A. Halogen, alkoxy and aryloxy groups are most suitable.

Examples of specific coupling-off groups are

—Cl, —F, —Br, —SCN, —$OCH_3$, —$OC_6H_5$,

—$OCH_2C(=O)NHCH_2CH_2OH$, —$OCH_2C(O)NHCH_2CH_2OCH_3$,

—$OCH_2C(O)NHCH_2CH_2OC(=O)OCH_3$, —$P(=O)(OC_2H_5)_2$,

—$SCH_2CH_2COOH$,

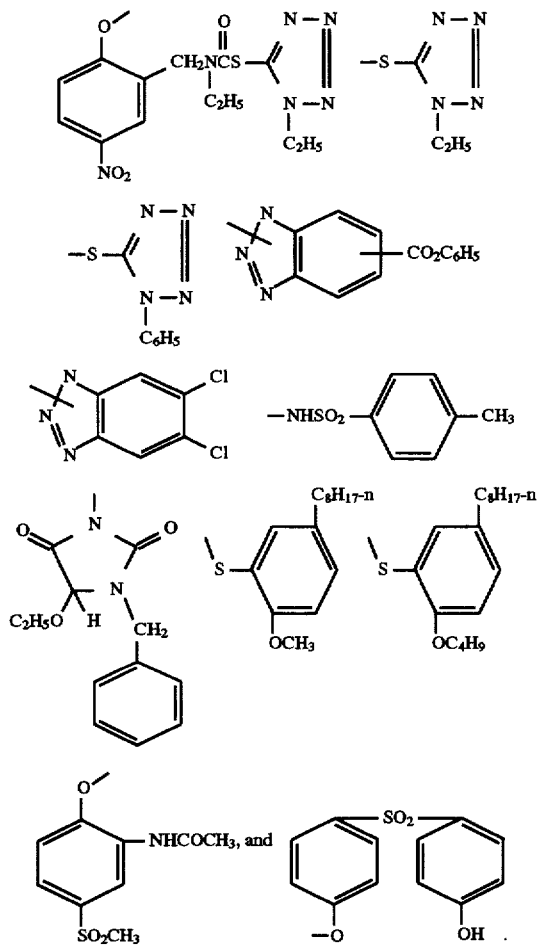

It is essential that the substituent groups $R_1$, $R_2$, X, and Z be selected so as to adequately ballast the coupler and the resulting dye in the organic solvent in which the coupler is dispersed. The ballasting may be accomplished by providing hydrophobic substituent groups in one or more of the substituent groups $R_1$, $R_2$, X, and Z. Generally a ballast group is an organic radical of such size and configuration as to confer on the coupler molecule sufficient bulk and aqueous insolubility as to render the coupler substantially non-diffusible from the layer in which it is coated in a photographic element. Thus the combination of substituent groups $R_1$, $R_2$, X, and Z in formula (I) are suitably chosen to meet these criteria. To be effective, the ballast must contain at least 8 carbon atoms, and may suitably located in substituent $R_1$, $R_2$, X, and Z of formula (I). Suitable ballasting may also be accomplished by providing a plurality of groups which in combination meet these criteria. Even if the coupling-off group Z contains a ballast, it is often necessary to ballast the other substituents as well, since Z is eliminated from the molecule upon coupling; thus, the ballast is most advantageously provided as part of groups $R_1$, $R_2$ and X or some combination thereof.

While the conventionally employed color developing agents behave in a similar manner with respect to the hue of the dye resulting from a particular coupler, a p-phenylene diamine developer having one of the following formulas:

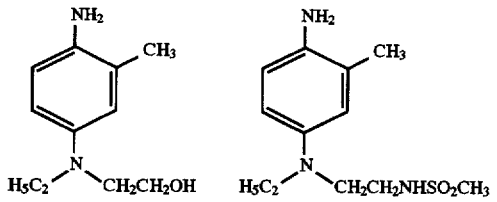
will produce a dye that has a wavelength of maximum absorbance less than 595 nm when reacted with a coupler of the invention.
The following examples of magenta dye-forming couplers further illustrate the invention.
M-1
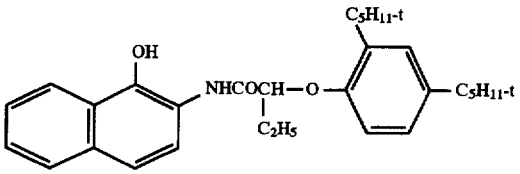
M-2
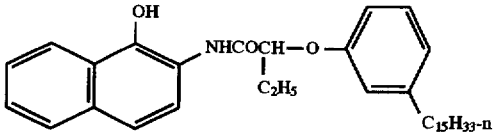
M-3
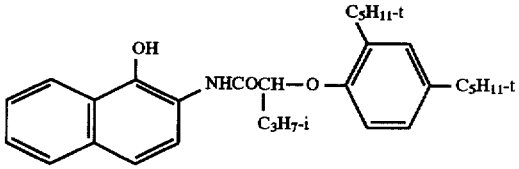
M-4
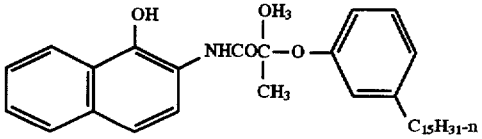
M-5
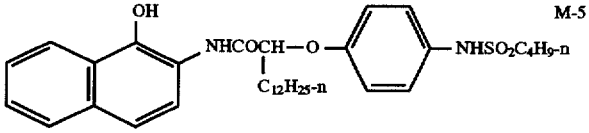
M-6
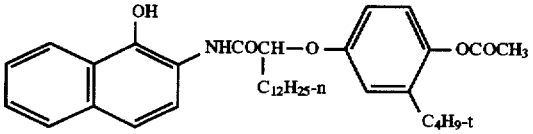
M-7
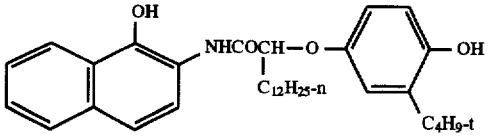
-continued
M-8
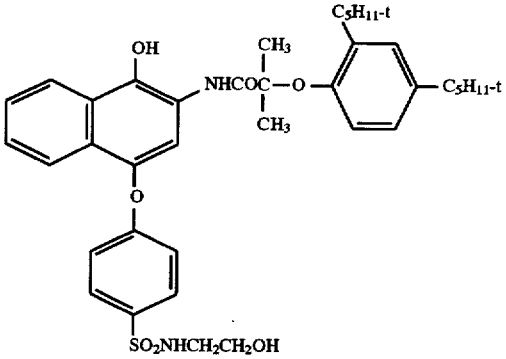
M-9
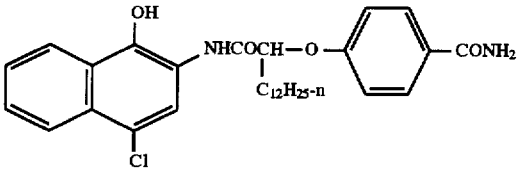
M-10
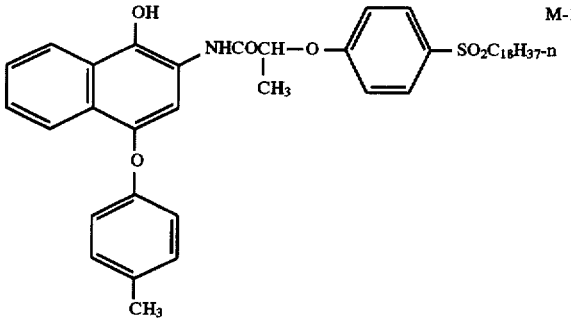
M-11
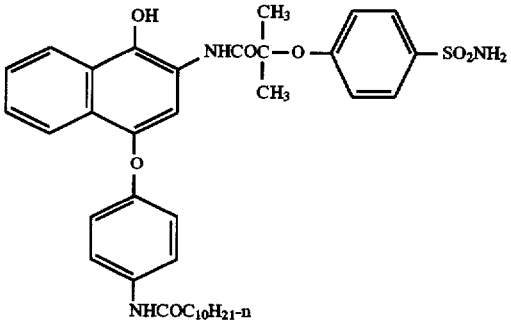
M-12
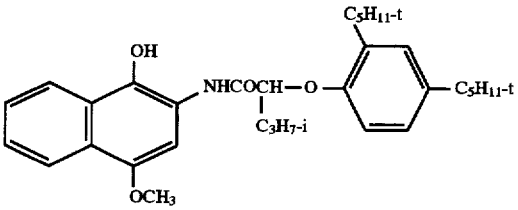

-continued
M-13
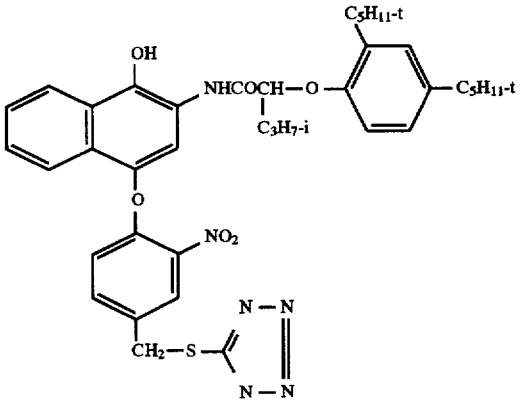
M-14
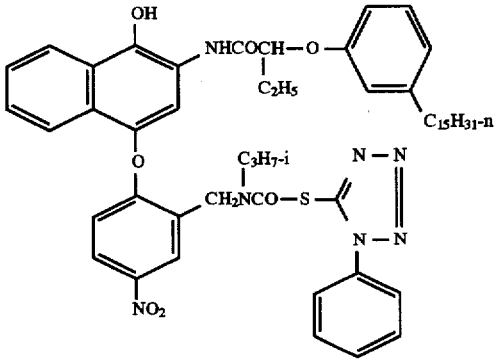
M-15
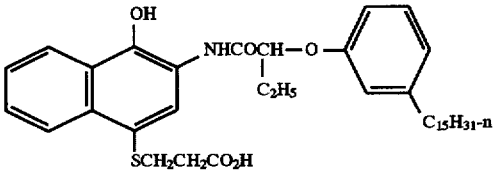
M-16
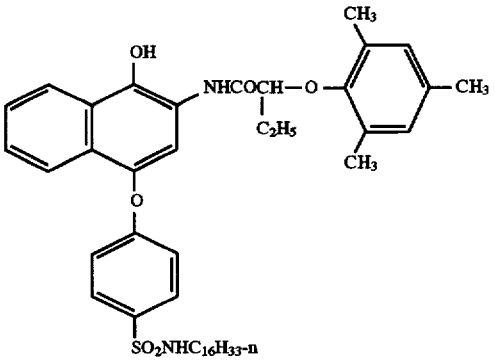
M-17
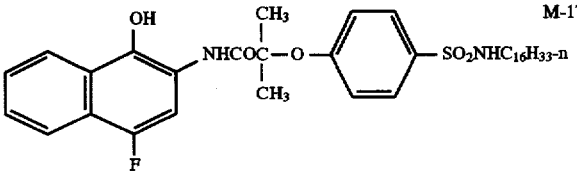
-continued
M-18
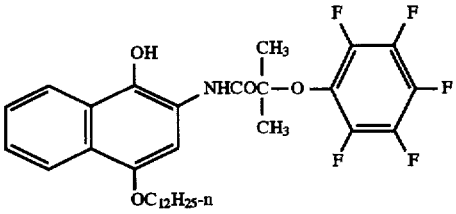
M-19
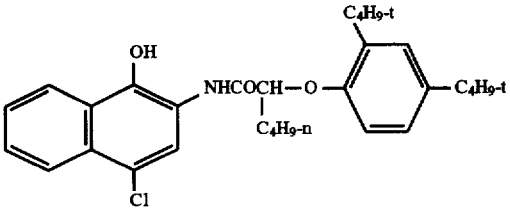
M-20
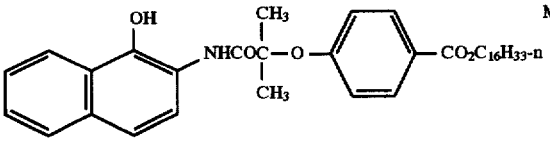
M-21
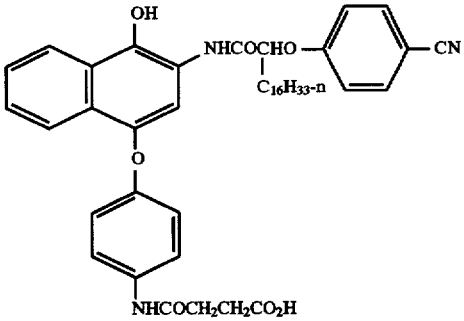
M-22
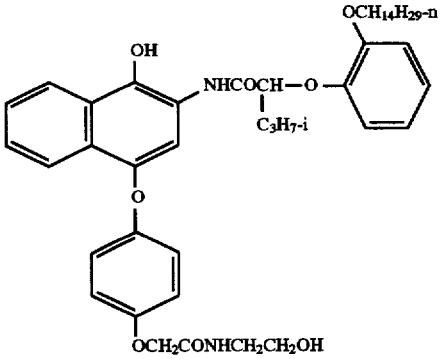
M-23
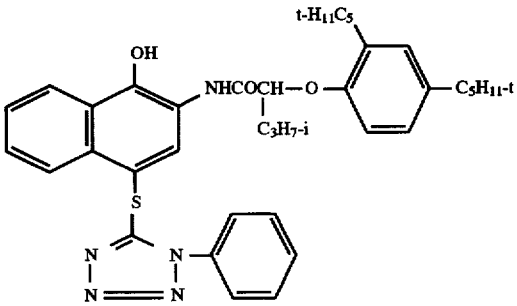

-continued

M-24

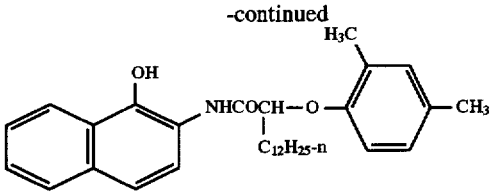

M-25

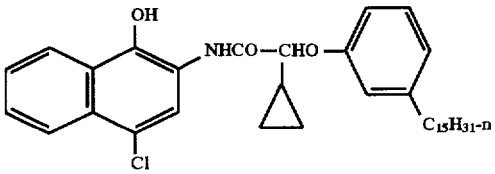

M-26

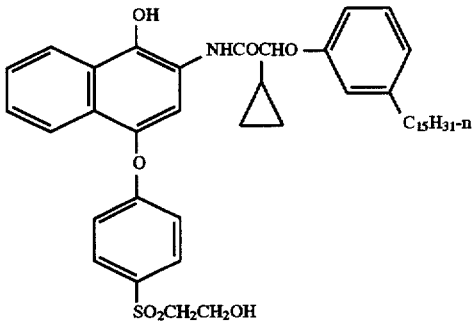

M-27

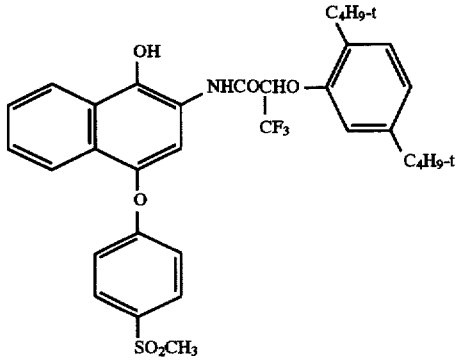

M-28

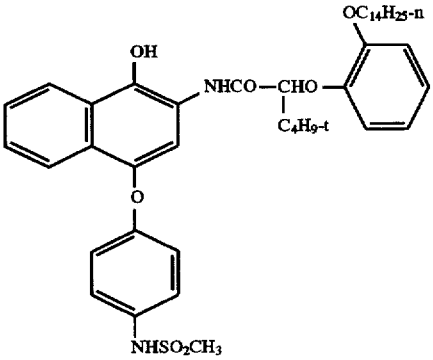

M-29

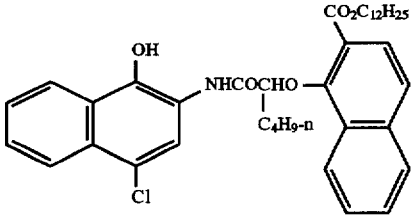

Unless otherwise specifically stated, substituent groups which may be substituted in X or R substituents herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

Representative ballast groups include substituted or unsubstituted alkyl or aryl groups containing up to 50 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers, other than those of the invention, that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIRs). DIRs useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4 579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

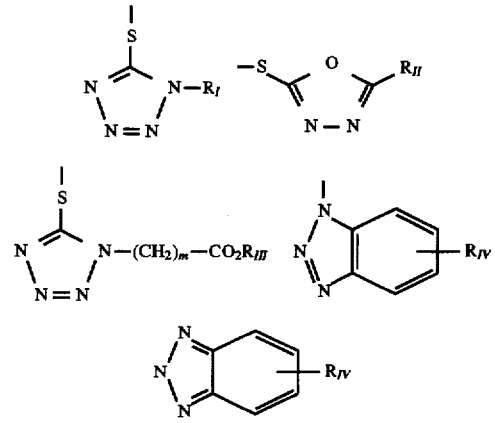

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

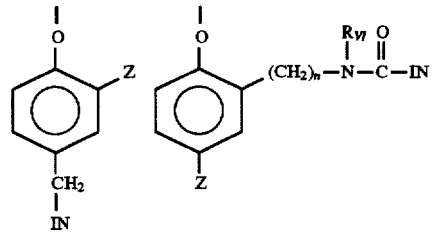

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

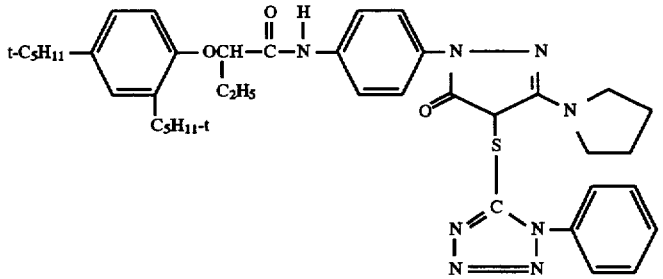

D2

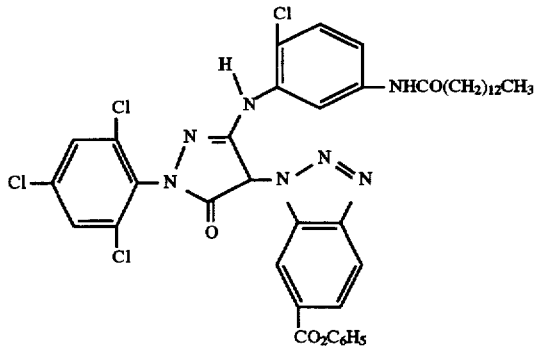

-continued
D3
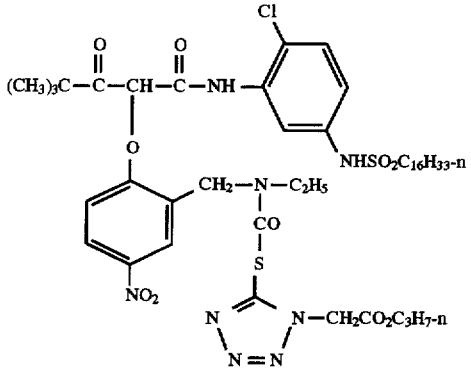
D4
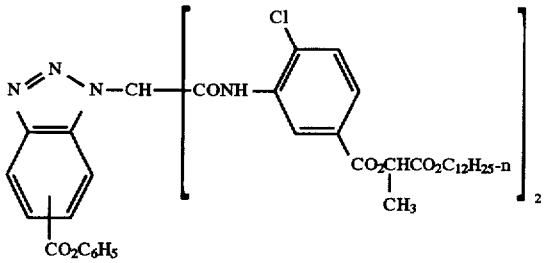
D5
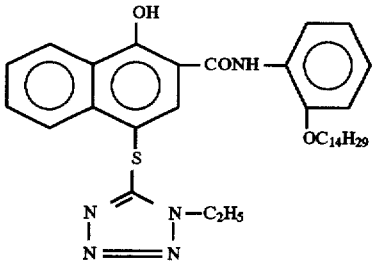
D6
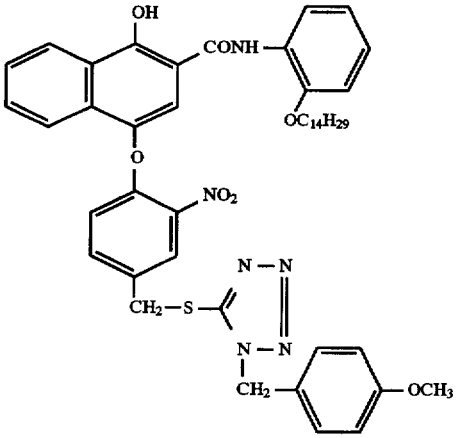

-continued
D7
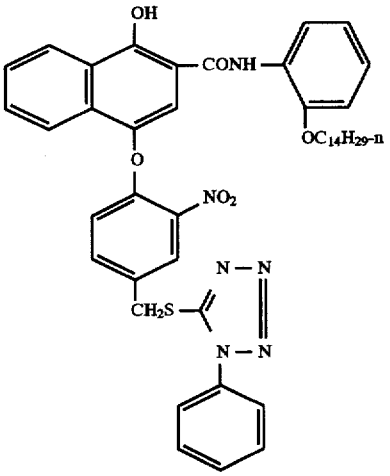
D8
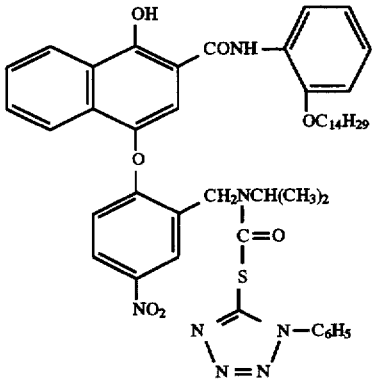
D9
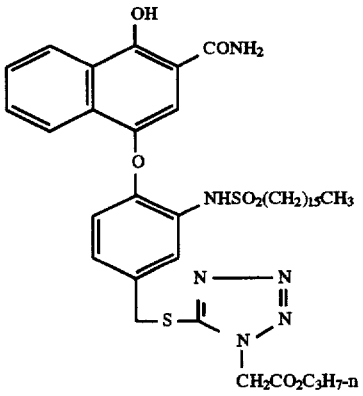

-continued

D10

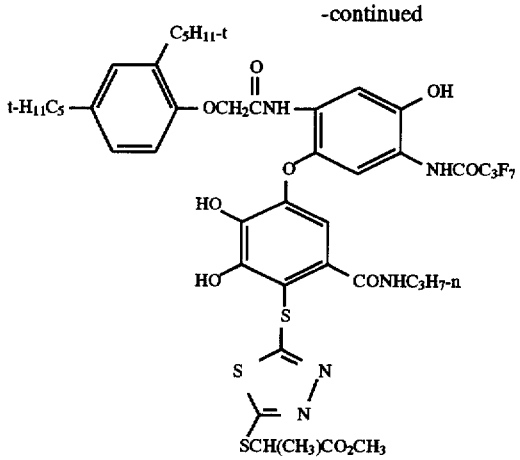

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

SYNTHESIS EXAMPLES

Magenta couplers of this invention can be readily prepared by reacting an appropriate alkyl or aryl acid chloride with commercially available 2-amino-1-naphthol or 2-amino-4-aryloxy-1-naphthol to form the 2-carbonamido-1-naphthol coupler. The following synthesis of couler compounds M-1 and M-2 will further illustrate the invention.

Preparation of Coupler Compound M-1

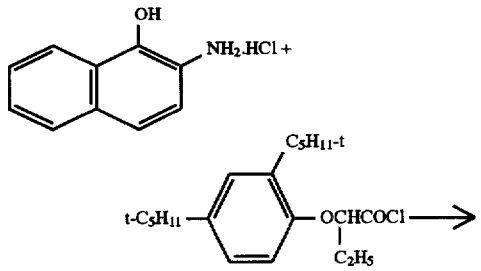

(M-1)

-continued

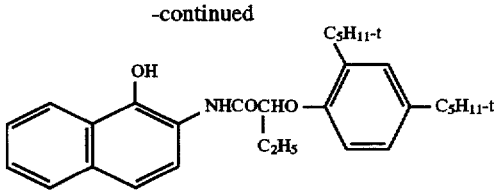

2-Amino-1naphthol hydrochloride (8.8 g, 0.045 mol) was suspended in 175 ml of THF and treated with 13.9 g (0.113 mol) of N,N-dimethylaniline. The resulting suspension was chilled to 10°–15° C. and treated with 17.7 g (0.0525 mol) of alpha-(2,4-di-t-amylphenoxy)butyryl chloride dissolved in 160 ml of THF. After warming to room temperature a solution resulted which was then stirred for 2 hours. The reaction mixture was poured onto 500 g of crushed ice and 25 ml 6N HCl, extracted with ethyl acetate, washed twice with water, dried over $MgSO_4$ and concentrated to give an oil which crystallized upon stirring with methanol to give 18.3 g of crude product. One recrystallization from methanol gave 16.3 g (71.0%) of white crystalline solid; m.p. 124°–126° C.

Calcd. for $C_{30}H_{39}NO_3$: C, 78.05; H, 8.52; N, 3.03 Found: C, 77.84; H, 8.28; N, 2.97

Preparation of Coupler Compound M-2

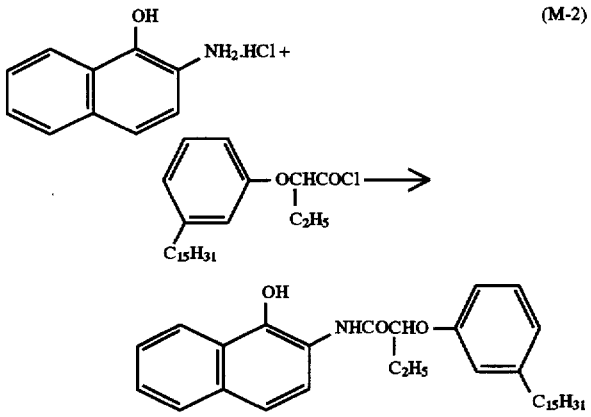

(M-2)

2-Amino-1-naphthol hydrochloride (7.15 g, 0.0366 mol) was suspended in 200 ml of THF, chilled to 10°–15° C. and treated with 11.1 g (0.0915 mol) of N,N-dimethylaniline. The resulting suspension was stirred for 5 minutes at 10° C., then treated dropwise with 15.7 g (0.0384 mol) of alpha-(3-n-pentadecylphenoxy)butyryl chloride dissolved in 100 ml of THF. After warming to room temperature a solution resulted which was then stirred for several hours. The amber solution was poured onto 500 g of crushed ice and 25 ml 6N Hcl. After all the ice had melted, the solid which precipitated was collected and dried to give 19.5 g of crude product. Recrystallization from methanol gave 14.5 g (75.0%) of white crystalline solid, m.p. 124°–126° C.

Calcd. for $C_{35}H_{49}NO_3$: C, 79.05; H, 9.19; N, 2.63 Found: C, 78.80; H, 9.02; N, 2.61

Preparation of Photographic Elements 101–115

On a cellulose acetate-butyrate support were coated the following layers:

First Layer

An emulsion layer comprising (per square meter) 3.77 grams gelatin, an amount of silver bromoiodide emulsion containing 0.9 gram silver, $1.61\times10^{-3}$ mole of the coupler indicated in Table 1, and an amount of the coupler solvent indicated in Table 1 equal to the weight of coupler.

Second Layer

A protective layer containing 2.69 grams gelatin and 0.12 gram bis(vinylsulfonyl)methane per square meter.

TABLE 1

| Element | Coupler | Solvent |
|---|---|---|
| 101 | M-1 | S-1 |
| 102 | M-2 | S-1 |
| 103 | M-3 | S-1 |
| 104 | M-4 | S-1 |
| 105 | M-5 | S-1 |
| 106 | M-6 | S-1 |
| 107 | M-7 | S-1 |
| 108 | M-2 | S-2 |
| 109 | M-2 | S-3 |
| 110 | M-2 | S-4 |
| 111 | C-1 | S-1 |
| 112 | C-2 | S-1 |
| 113 | C-3 | S-1 |
| 114 | C-4 | S-1 |
| 115 | C-5 | S-1 |

The comparison couplers used were:

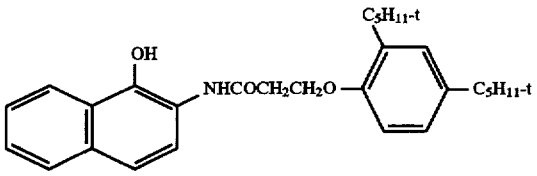

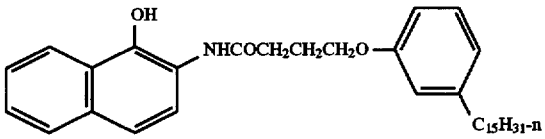

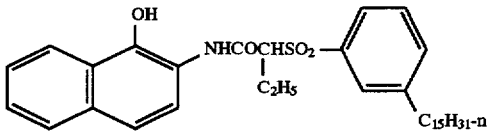

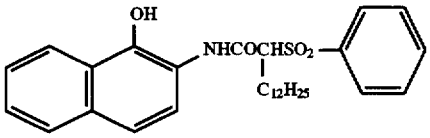

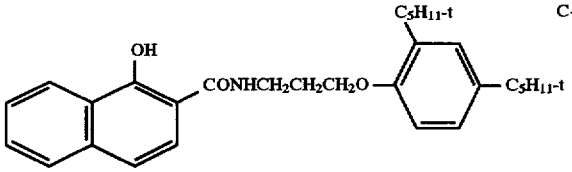

It will be noted that the comparison couplers C-1 through C-4, like the couplers of the invention, are 2-acylaminonaphthols; however, their structures are not as specified in Formula I. Couplers C-1 and C-2 have more than one methylene group separating the amido function and the aryloxy group, and couplers C-3 and C-4 have arylsulfone groups instead of aryloxy groups. Comparison coupler C-5 is a 1-amino-2-naphthamide coupler used in many color negative films. The coupler solvents used were:

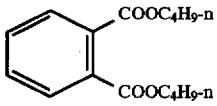

S-1

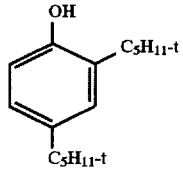

S-2

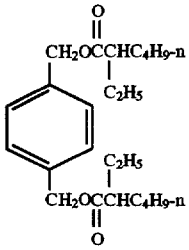

S-3

$CH_3(CH_2)_{10}CON(C_4H_9\text{-}n)_2$ S-4

Preparation of Processed Photographic Examples 201–211

Processed film samples 201–211 were prepared by exposing photographic elements selected from elements 101–115 through a step wedge and processing as follows:

| Process Step | Time (min.) | Temp. (°C.) |
|---|---|---|
| Developer | 2.75 | 37.8 |
| Stop Bath | 0.30 | 37.8 |
| Bleach | 4.00 | 37.8 |
| Water wash | 3.00 | 37.8 |
| Fixer | 4.00 | 37.8 |
| Water wash | 3.00 | 37.8 |

The processing solutions used in the above process had the following compositions (amounts per liter of solution):

| | |
|---|---|
| Developer | |
| Potassium carbonate | 37.50 g |
| Sodium sulfite | 4.00 g |
| Potassium iodide | 1.20 mg |
| Sodium bromide | 1.30 g |
| 1,3-Diamino-2-propanoltetraacetic acid | 2.50 g |
| Hydroxylamine sulfate | 2.00 g |
| Developing agent Dev-1 | 4.50 g |
| pH adjusted to 10.00 at 26.7 C. | |
| Stop bath | |
| Sulfuric acid | 10.00 g |
| Bleach | |
| Ammonium bromide | 150.00 g |
| Ammonium ferric ethylenediaminetetra acetate | 77.00 g |
| Ethylenediaminetetraacetic acid | 6.13 g |
| Acetic acid | 9.50 mL |
| Sodium nitrate | 35.00 g |
| pH adjusted to 6.00 at 26.7 C. | |
| Fixer | |
| Ammonium thiosulfate | 91.53 g |

-continued

| | |
|---|---|
| Ammonium sulfite | 6.48 g |
| Sodium metabisulfite | 1.00 g |
| pH adjusted to 6.50 at 26.7 C. | |

Dev-1

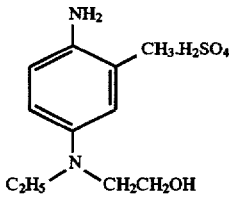

The spectra of the resulting dyes were measured and normalized to a maximum absorption of 1.00. The wavelength in nanometers at the maximum absorption is shown in Table 2.

TABLE 2

| Example | Element | Coupler | Solvent | Dye Hue | Wavelength |
|---|---|---|---|---|---|
| 201 | 101 | M-1 | S-1 | Magenta | 581 |
| 202 | 102 | M-2 | S-1 | Magenta | 576 |
| 203 | 103 | M-3 | S-1 | Magenta | 583 |
| 204 | 104 | M-4 | S-1 | Magenta | 510 |
| 205 | 105 | M-2 | S-2 | Magenta | 583 |
| 206 | 109 | M-2 | S-3 | Magenta | 579 |
| 207 | 111 | C-1 | S-1 | Cyan | 644 |
| 208 | 112 | C-2 | S-1 | Cyan | 642 |
| 209 | 113 | C-3 | S-1 | Cyan | 653 |
| 210 | 114 | C-4 | S-1 | Cyan | 656 |
| 211 | 115 | C-5 | S-1 | Cyan | 703 |

The data in Table 2 show that the couplers of the invention yield magenta dyes, while the comparison couplers yield cyan dyes, as is typical of naphtholic couplers known in the art.

Preparation of Processed Photographic Examples 301–315

Processed film samples 301–315 were prepared by exposing photographic elements 101–115 through a step wedge and processing as follows:

| Process Step | Time (min.) | Temp. (°C.) |
|---|---|---|
| Developer | 2.00 | 41.1 |
| Stop Bath | 0.30 | 41.1 |
| Water wash | 0.30 | 41.1 |
| Bleach | 3.00 | 41.1 |
| Water wash | 1.00 | 41.1 |
| Fixer | 2.00 | 41.1 |
| Water wash | 2.00 | 41.1 |

The processing solutions used in the above process had the following compositions (amounts per liter of solution):

| | |
|---|---|
| Developer | |
| Sodium carbonate | 30.00 g |
| Sodium bicarbonate | 2.75 g |
| Sodium sulfite | 2.00 g |
| Sodium bromide | 1.20 g |
| Aminotris(methylenephosphonic acid), pentasodium salt | 1.13 g |
| 3,5-dinitrobenzoic acid | 0.22 g |

-continued

| | |
|---|---|
| Developing agent Dev-2 | 4.00 g |
| Sulfuric acid | 0.17 ml |
| pH adjusted to 10.2 at 26.7 C. | |
| Stop bath | |
| Sulfuric acid | 10.00 g |
| Bleach | |
| Potassium ferricyanide | 50.00 g |
| Sodium bromide | 17.00 g |
| pH adjusted to 6.5–7.0 at 23.9 C. | |
| Fixer | |
| Ammonium thiosulfate | 104.53 g |
| Ammonium sulfite | 7.40 g |
| Sodium sulfite | 10.00 g |
| Sodium metabisulfite | 8.40 g |
| pH adjusted to 6.50 at 26.7 C. | |

Dev-2

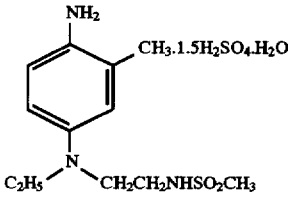

The spectra of the resulting dyes were measured and normalized to a maximum absorption of 1.00. The wavelength in nanometers at the maximum absorption is shown in Table 3.

TABLE 3

| Example | Element | Coupler | Solvent | Dye Hue | Wavelength |
|---|---|---|---|---|---|
| 301 | 101 | M-1 | S-1 | Magenta | 576 |
| 302 | 102 | M-2 | S-1 | Magenta | 578 |
| 303 | 103 | M-3 | S-1 | Magenta | 577 |
| 304 | 104 | M-4 | S-1 | Magenta | 510 |
| 305 | 105 | M-5 | S-1 | Magenta | 591 |
| 306 | 106 | M-6 | S-1 | Magenta | 581 |
| 307 | 107 | M-7 | S-1 | Magenta | 579 |
| 308 | 108 | M-2 | S-2 | Magenta | 576 |
| 309 | 109 | M-2 | S-3 | Magenta | 572 |
| 310 | 110 | M-2 | S-4 | Magenta | 573 |
| 311 | 111 | C-1 | S-1 | Cyan | 699 |
| 312 | 112 | C-2 | S-1 | Cyan | 696 |
| 313 | 113 | C-3 | S-1 | Cyan | 635 |
| 314 | 114 | C-4 | S-1 | Cyan | 630 |
| 315 | 115 | C-4 | S-1 | Cyan | 692 |

The data in Table 3 show that the couplers of the invention yield magenta dyes, while the comparison couplers yield cyan dyes, as is typical of naphtholic couplers.

The entire contents of the various copending applications as well as patents and other publications cited in this specification are incorporated herein by reference.

What is claimed is:

1. A negative working multicolor photographic element comprising a support bearing a silver halide emulsion layer sensitive to green light having associated therewith a magenta dye-forming coupler; a silver halide emulsion layer sensitive to blue light having associated therewith a yellow dye-forming coupler; and a silver halide emulsion layer sensitive to red light having associated therewith a cyan dye-forming coupler; wherein the magenta dye forming coupler has formula (I):

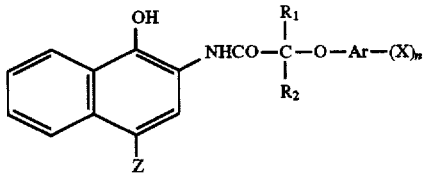

(I)

wherein:

$R_1$ represents a hydrogen atom or an alkyl group;

$R_2$ represents an alkyl group;

Ar represents a phenyl or naphthyl group;

X represents a substituent and "n" represents an integer of from 1 to 5; and

Z represents a hydrogen atom or a group which can be split off by the reaction of the coupler with an oxidized color developing agent.

2. The element of claim 1 wherein $R_2$ is a straight chain alkyl group.

3. The element of claim 1 wherein $R_2$ contains up to 16 carbon atoms.

4. The element of claim 1 wherein $R_2$ is a cycloalkyl group.

5. The element of claim 1 wherein $R_2$ is a substituted alkyl group.

6. The element of claim 1 wherein $R_1$ is hydrogen.

7. The element of claim 1 wherein $R_1$ is an alkyl group.

8. The element of claim 1 wherein there is present at least one X selected from the group consisting of halogen, cyano, hydroxyl, alkyl, alkoxy, acyloxy, sulfonamido, sulfamoyl, carbonamido, carbamoyl, sulfonyl, and carboxyl groups.

9. The element of claim 8 wherein there is present at least one X which is alkyl.

10. The element of claim 1 wherein the coupler has a formula such that the dye formed upon coupling with a p-phenylene diamine developer having either of the following formulas:

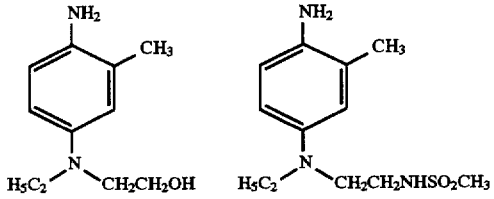

has a wavelength of maximum absorbance less than 595 nm.

11. The element of claim 10 wherein the element is one which produces a color image for direct viewing.

12. The element of claim 10 wherein the element is one which produces a color negative of the image to which it is exposed which is to be used to produce the desired image for direct viewing.

13. The element of claim 1 wherein Ar is a phenyl group.

14. The element of claim 13 wherein there is present on the phenyl ring at least one X substituent in a position meta or para to the oxygen link.

15. The element of claim 1 wherein Z is hydrogen.

16. The element of claim 1 wherein Z is a halogen or is a group linked to the coupler by an atom of oxygen, sulfur or nitrogen.

17. The element of claim 1 wherein Z is selected from the group consisting of halogen, phenoxy, phenylthio, alkoxy, alkylthio, and mercapatotetrazole.

18. A process for forming an image in a photographic element as in claim 1 after the element has been imagewise exposed, comprising contacting the element with a color developing agent.

* * * * *